US012704303B2

(12) United States Patent
Shi et al.

(10) Patent No.: US 12,704,303 B2
(45) Date of Patent: Aug. 11, 2026

(54) GAS-LIQUID SEPARATION DEVICE AND THERMAL MANAGEMENT SYSTEM

(71) Applicant: ZHEJIANG SANHUA INTELLIGENT CONTROLS CO., LTD., Shaoxing City (CN)

(72) Inventors: Haimin Shi, Shaoxing City (CN); Chaochao Cao, Shaoxing City (CN); Mei Wang, Shaoxing City (CN)

(73) Assignee: ZHEJIANG SANHUA INTELLIGENT CONTROLS CO., LTD., Shaoxing City (CN)

( * ) Notice: Subject to any disclaimer, the term of this patent is extended or adjusted under 35 U.S.C. 154(b) by 294 days.

(21) Appl. No.: 18/398,089

(22) Filed: Dec. 27, 2023

(65) Prior Publication Data

US 2024/0210079 A1 Jun. 27, 2024

(30) Foreign Application Priority Data

Dec. 27, 2022 (CN) ..... 202211684531.8

(51) Int. Cl.
*F25B 43/00* (2006.01)

(52) U.S. Cl.
CPC ..... *F25B 43/006* (2013.01); *F25B 2341/001* (2013.01); *F25B 2500/28* (2013.01)

(58) Field of Classification Search
CPC ..... F25B 43/006; F25B 2341/001; F25B 2500/28; F25B 2400/16
See application file for complete search history.

(56) References Cited

U.S. PATENT DOCUMENTS

| | | | | |
|---|---|---|---|---|
| 7,086,248 | B2 * | 8/2006 | Sakai | F25B 43/006 62/500 |
| 12,152,817 | B2 * | 11/2024 | Dong | F28F 1/422 |
| 2012/0291462 | A1 | 11/2012 | Verma et al. | |
| 2021/0247114 | A1 | 8/2021 | Li et al. | |
| 2023/0003428 | A1 | 1/2023 | Dong et al. | |

FOREIGN PATENT DOCUMENTS

| | | | |
|---|---|---|---|
| CN | 101825404 | A | 9/2010 |
| CN | 202511537 | U | 10/2012 |
| CN | 208832787 | U | 5/2019 |

(Continued)

*Primary Examiner* — Miguel A Diaz
(74) *Attorney, Agent, or Firm* — Cheng-Ju Chiang

(57) ABSTRACT

A gas-liquid separation device includes a first cylinder, a second cylinder, a heat exchange assembly and a gas-liquid separation assembly. The gas-liquid separation device defines a first cavity and a second cavity. The first cavity includes a space between the first cylinder and the second cylinder. The second cavity includes an inner cavity of the second cylinder. The gas-liquid separation assembly is at least partially located in the second cavity. An inner cavity of the gas-liquid separation assembly is in communication with the first cavity and the second cavity. At least part of the heat exchange assembly is located in the first cavity. The gas-liquid separation device includes a first pipe portion. A pipe cavity of the first pipe portion communicates with the second cavity and an outer space of the first cylinder. A thermal management system having the gas-liquid separation device is also disclosed.

19 Claims, 9 Drawing Sheets

(56) References Cited

FOREIGN PATENT DOCUMENTS

| | | | |
|---|---|---|---|
| CN | 110195947 | A | 9/2019 |
| CN | 110195948 | A | 9/2019 |
| CN | 112432400 | A | 3/2021 |
| CN | 112444013 | A | 3/2021 |
| CN | 113175771 | A | 7/2021 |
| CN | 114379310 | A | 4/2022 |
| CN | 216620374 | U | 5/2022 |
| CN | 115371309 | A | 11/2022 |
| EP | 0735335 | A2 | 10/1996 |
| JP | 2008-304077 | A | 12/2008 |
| WO | 2018/088166 | A1 | 5/2018 |
| WO | 2021/197450 | A1 | 10/2021 |
| WO | 2021/219026 | A1 | 11/2021 |

* cited by examiner

GAS-LIQUID SEPARATION DEVICE AND THERMAL MANAGEMENT SYSTEM

CROSS-REFERENCE TO RELATED APPLICATION

The present application claims priority of a Chinese Patent Application No. 202211684531.8, filed on Dec. 27, 2022 and titled "GAS-LIQUID SEPARATION DEVICE AND THERMAL MANAGEMENT SYSTEM", the entire content of which is incorporated herein by reference.

TECHNICAL FIELD

The present disclosure relates to the field of thermal management technologies, and in particular, to a gas-liquid separation device and a thermal management system.

BACKGROUND

A gas-liquid separation device integrating heat exchange and gas-liquid separation functions includes a top cover, a bottom cover, an inner cylinder, an outer cylinder, and an interlayer cavity located between the inner cylinder and the outer cylinder. A gas-liquid separation assembly is located inside the inner cylinder. A heat exchange assembly is located in the interlayer cavity. A gaseous refrigerant after gas-liquid separation by the gas-liquid separation assembly enters the interlayer cavity, and then performs heat exchange with the heat exchange assembly. A liquid refrigerant is stored in an inner cavity of the inner cylinder.

In an electric vehicle heat pump air conditioning system, the gas-liquid separation device is disposed between an outlet of an evaporator and an inlet of a compressor in order to separate the gas-liquid two-phase refrigerant at the outlet of the evaporator and return the refrigeration oil accumulated inside to the compressor. The refrigerant coming out of the evaporator is generally high-temperature and low-pressure refrigerant. After the high-temperature and low-pressure refrigerant enters the gas-liquid separation device, the separated gaseous refrigerant enters the compressor and is pressurized to become high-temperature and high-pressure refrigerant. The gas-liquid separation devices in the related art are mostly manufactured using metal welding processes, and the gas-liquid separation devices are high in cost and heavy in weight. The quality of interior accessories in the electric vehicle field is an important factor affecting battery life. Therefore, how to reduce the weight of the gas-liquid separation device is a technical problem to be solved in this field.

SUMMARY

An object of the present disclosure is to provide a gas-liquid separation device with a liquid return function.

Another object of the present disclosure is to provide a gas-liquid separation device capable of reducing product weight.

An object of the present disclosure is to provide a thermal management system having the gas-liquid separation device.

In order to achieve the above object, the present disclosure adopts the following technical solution: a gas-liquid separation device, including: a first cylinder, a second cylinder, a heat exchange assembly and a gas-liquid separation assembly; the second cylinder being located inside the first cylinder; the gas-liquid separation device defining a first cavity and a second cavity; the first cavity at least including a space between the first cylinder and the second cylinder; the second cavity at least including an inner cavity of the second cylinder; the gas-liquid separation assembly being at least partially located in the second cavity; an inner cavity of the gas-liquid separation assembly being in communication with the first cavity and the second cavity; at least part of the heat exchange assembly being located in the first cavity; wherein the gas-liquid separation device includes a first pipe portion; a pipe cavity of the first pipe portion communicates with the second cavity and an outer space of the first cylinder.

In the present disclosure, the gas-liquid separation device is provided with the first pipe portion. The pipe cavity of the first pipe portion communicates with the second cavity and the outer space of the first cylinder. When the gas-liquid separation device is in an application state, the liquid refrigerant in the second cylinder can be led out of the gas-liquid separation device through the first pipe portion so as to realize a liquid return function of a thermal management system.

In order to achieve the above object, the present disclosure adopts the following technical solution: a gas-liquid separation device, including: a second cylinder, a second end cover and a gas-liquid separation assembly; the second end cover and the second cylinder being fixedly arranged; wherein the gas-liquid separation device defines a second cavity in which the gas-liquid separation assembly is at least partially located; the second end cover includes a base portion; the base portion defines a first mounting tunnel extending through the base portion along an axial direction of the gas-liquid separation device; the gas-liquid separation assembly includes a cover body portion which includes a plate portion and a limiting portion; the limiting portion extends outward from the plate portion; the limiting portion is at least partially located and snap-fastened in the first mounting tunnel.

In the present disclosure, the second end cover is provided with the first mounting tunnel, the cover body portion is provided with the limiting portion, and the limiting portion is at least partially located in the first mounting tunnel and is snap-fastened. Such a structural design is beneficial to realize that the second cylinder and the second end cover are prepared by injection molding process, which helps to reduce the weight of the product.

In order to achieve the above object, the present disclosure adopts the following technical solution: a thermal management system, including: a compressor, an evaporator, a condenser, an expansion valve, an ejector and a gas-liquid separation device; wherein the gas-liquid separation device includes a first cylinder, a second cylinder, a heat exchange assembly and a gas-liquid separation assembly; the second cylinder is at least partially located inside the first cylinder; the gas-liquid separation device defines a first cavity and a second cavity; the first cavity at least includes a space between the first cylinder and the second cylinder; the second cavity at least includes an inner cavity of the second cylinder; the gas-liquid separation assembly is at least partially located in the second cavity; an inner cavity of the gas-liquid separation assembly is in communication with the first cavity and the second cavity; at least part of the heat exchange assembly is located in the first cavity; the gas-liquid separation device includes a first pipe portion; a pipe cavity of the first pipe portion communicates with the second cavity and an outer space of the first cylinder; an outlet of the compressor communicates with an inlet of the condenser; an outlet of the condenser communicates with a first inlet of the ejector; an outlet of the evaporator communicates with a second inlet of the ejector; a first outlet of the ejector communicates with the second cavity; the first cavity communicates with an inlet of the compressor; an inlet of the evaporator communicates with an outlet of the expansion valve; and an inlet of the expansion valve communicates with the pipe cavity of the first pipe portion.

In the thermal management system of the present disclosure, the liquid refrigerant in the second cylinder can be led out of the gas-liquid separation device through the first pipe portion of the gas-liquid separation device, and then to the evaporator to achieve a liquid return function, which ensures the thermal management system to operate properly.

DETAILED DESCRIPTION

Figure 1:
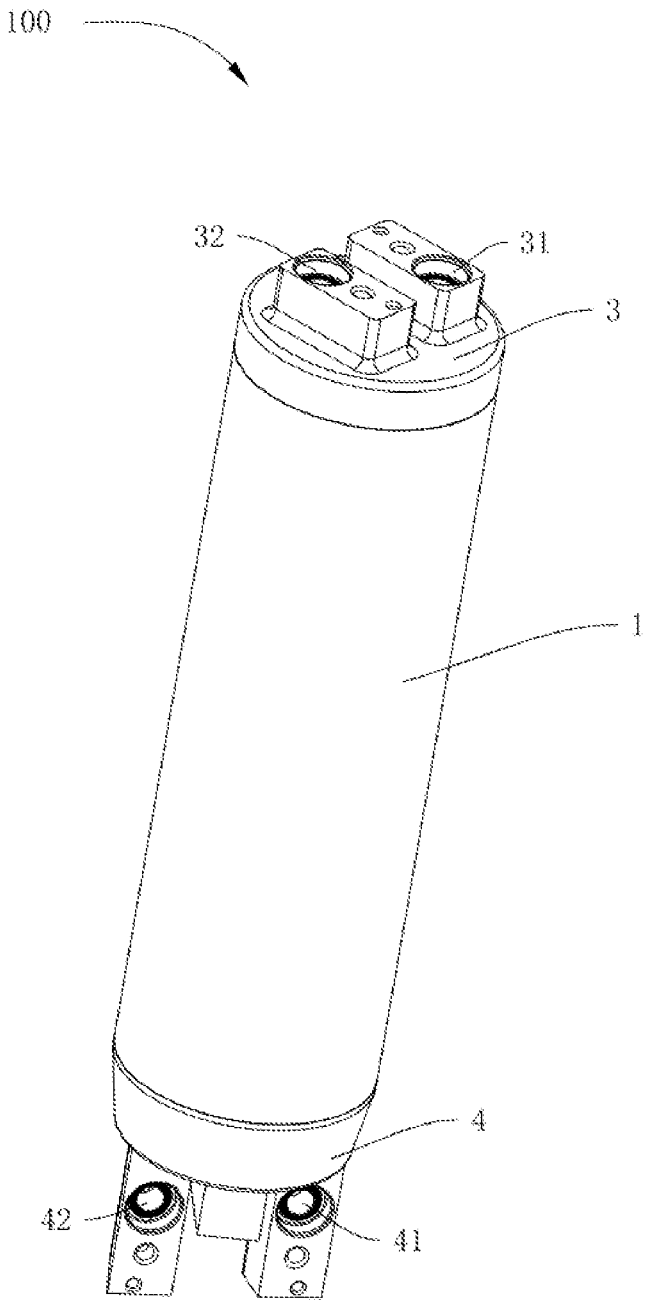
FIG. 1 is a schematic structural view of a gas-liquid separation device in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with the present disclosure. Rather, they are merely examples of devices and methods consistent with some aspects of the present disclosure as detailed in the appended claims.

The terminology used in the present disclosure is only for the purpose of describing particular embodiments, and is not intended to limit the present disclosure. The singular forms "a", "said", and "the" used in the present disclosure and the appended claims are also intended to include plural forms unless the context clearly indicates other meanings.

It should be understood that the terms "first", "second" and similar words used in the specification and claims of the present disclosure do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects.

Hereinafter, some embodiments of a gas-liquid separation device in the present disclosure will be described in detail with reference to the accompanying drawings. In the case of no conflict, the following embodiments and features in the embodiments can complement or be combined with each other.

A specific embodiment of a gas-liquid separation device 100 is disclosed in the present disclosure. As shown in FIGS. 1 to 8, the gas-liquid separation device 100 includes a first cylinder 1, a second cylinder 2, a first flow guide portion 4, a second flow guide portion, a gas-liquid separation assembly 7 and a heat exchange assembly 6.

The gas-liquid separation device 100 defines a first cavity 10 and a second cavity 20 that are in fluid communication. The first cavity 10 is located outside the second cylinder 2, and the first cavity 10 is located inside the first cylinder 1. The first cavity 10 at least includes a space between the first cylinder 1 and the second cylinder 2. The second cavity 20 is located in the second cylinder 2. The second cavity 20 at least includes a space inside the second cylinder 2. The gas-liquid separation assembly 7 is at least partially located in the second cavity 20. The heat exchange assembly 6 is at least partially located in the first cavity 10. An inner cavity of the gas-liquid separation assembly 7 is capable of communicating with the first cavity 10 and the second cavity 20.

Figure 2:
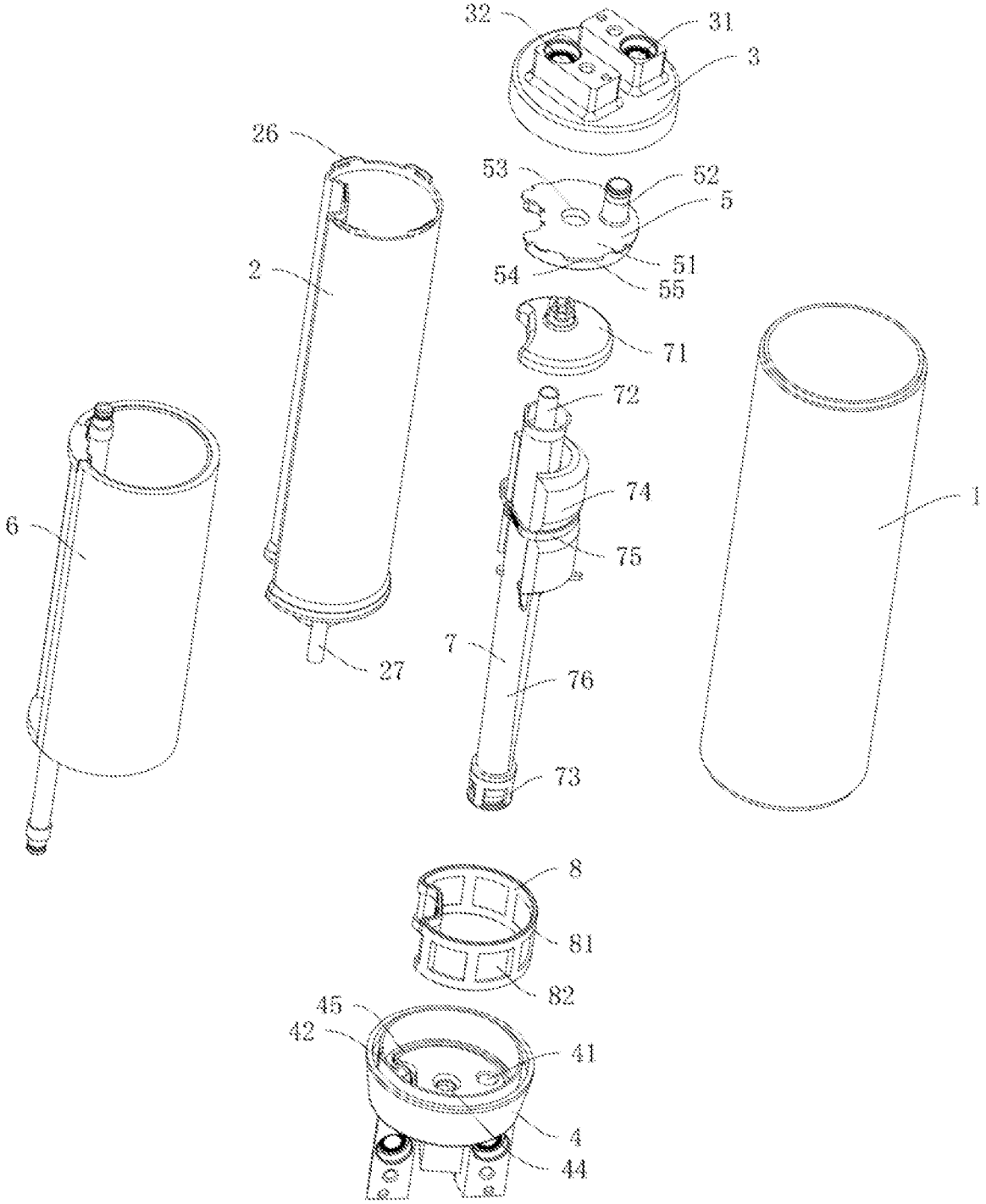
FIG. 2 is an exploded schematic view of the gas-liquid separation device in accordance with an embodiment of the present disclosure.
Figure 7:
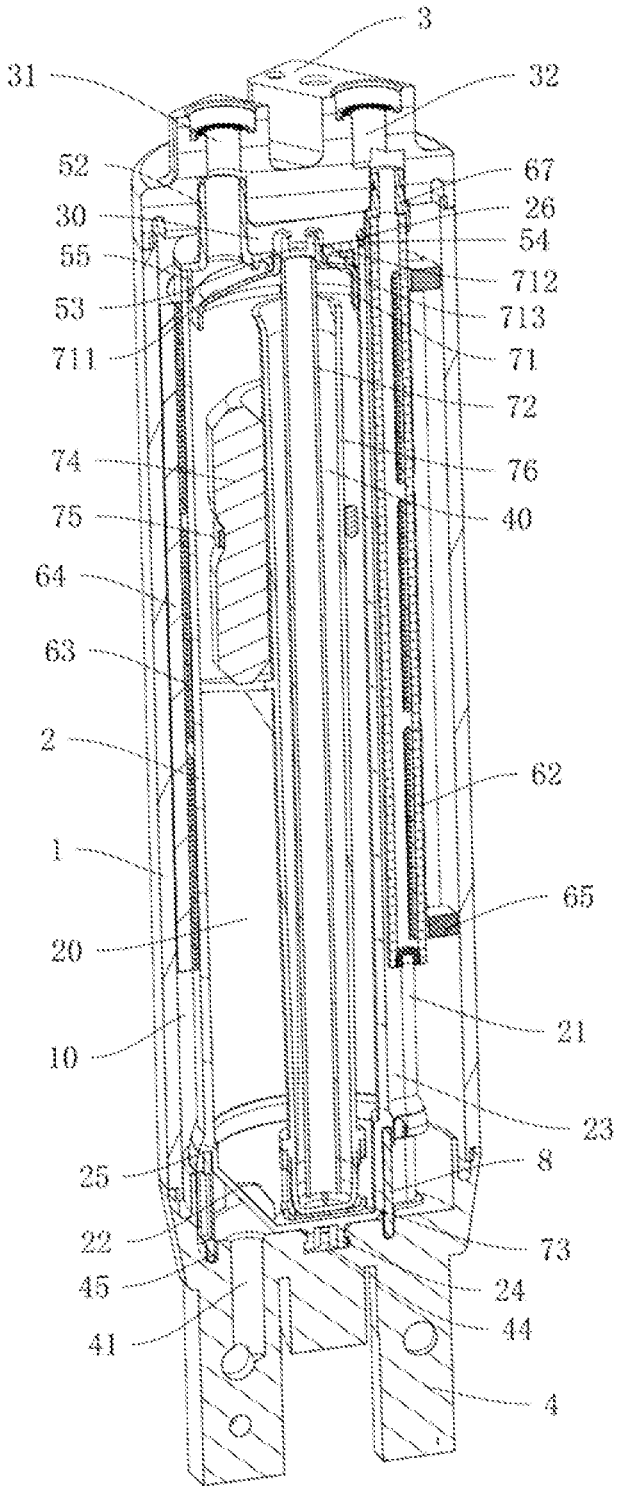
FIG. 7 is a schematic cross-sectional structural view of the gas-liquid separation device in accordance with an embodiment of the present disclosure.
Figure 8:
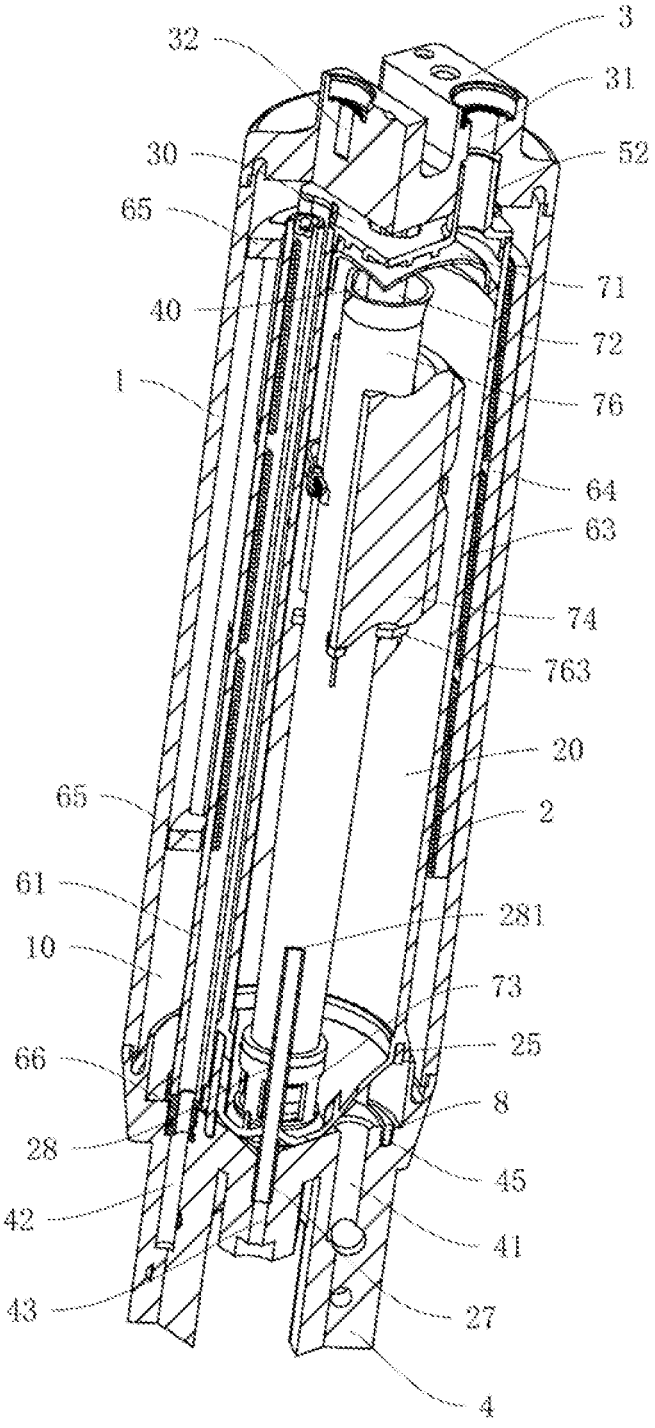
FIG. 8 is a schematic cross-sectional structural view of the gas-liquid separation device in accordance with an embodiment of the present disclosure.

The first cylinder 1 is an approximately cylindrical structure with a hollow interior and open ends. The first flow guide portion 4 and the second flow guide portion are fixedly arranged on opposite ends of the first cylinder 1, respectively, in an axial direction. Referring to FIGS. 2, 7 and 8, in this embodiment, the second flow guide portion includes a first end cover 3 and a second end cover 5 that are independently formed. The first end cover 3 and the second end cover 5 are connected to each other and disposed at a certain distance. The first end cover 3 and the first cylinder 1 are fixedly arranged. The second end cover 5 and the second cylinder 2 are fixedly arranged. The second cylinder 2 has a hollow interior structure with a bottom cover. The second end cover 5 covers a side of the second cylinder 2 away from the bottom cover. A relatively sealed second cavity 20 is formed between the second end cover 5 and the second cylinder 2. A relatively sealed first cavity 10 is formed between the first flow guide portion 4, the second flow guide portion, the first cylinder 1 and the second cylinder 2. A space between the first end cover 3 and the second end cover 5 forms a third cavity 30. The third cavity 30 is in communication with the first cavity 10 and the inner cavity of the gas-liquid separation assembly 7.

In this embodiment, the second cylinder 2 includes a side portion 21, a bottom portion 22, a first pipe portion 27 and a second pipe portion 28. The side portion 21 extends in an axial direction of the gas-liquid separation device 100. The side portion 21 has an approximately cylindrical structure with a hollow interior. One end of the side portion 21 is hermetically connected to the second end cover 5. The bottom portion 22 is located at an end of the side portion 21 away from the second end cover 5. The bottom portion 22 is hermetically connected to the side portion 21. One end of the bottom portion 22 away from the side portion 21 is fixedly connected to the first flow guide portion 4. The bottom portion 22 is approximately a bowl-shaped structure, and an opening of the bowl-shaped structure faces the side portion 21. The side portion 21 and the bottom portion 22 form a main portion in which the second cavity 20 is located. The first pipe portion 27 extends from the bottom portion 22 along the axial direction of the gas-liquid separation device 100. The first pipe portion 27 is partially located in the first cavity 10. An extending end portion of the first pipe portion 27 is hermetically connected to the first flow guide portion 4. The second pipe portion 28 extends from the bottom portion 22 along the axial direction of the gas-liquid separation device 100. The second pipe portion 28 is located in the second cavity 20. A pipe cavity of the second pipe portion 28 is in communication with a pipe cavity of the first pipe portion 27 and the second cavity 20. Optionally, the second cylinder 2 is integrally of one piece, which can increase the strength of the second cylinder 2, simplify the manufacture of the second cylinder 2, and reduce the risk of leakage.

Optionally, the axial direction of the gas-liquid separation device 100 is defined as a height direction. A height value at which an extending end 281 of the second pipe portion 28 is located is a, and a length value of the second cylinder 2 in the axial direction of the gas-liquid separation device 100 is b, where $0.5\ b \geq a \geq 0.125\ b$. Through such an arrangement, it can be ensured that the liquid first fluid can enter the pipe cavity of the second pipe portion 28, but a liquid oil cannot enter the pipe cavity of the second pipe portion 28.

In some other embodiments, the second cylinder 2 includes a side portion 21, a bottom portion 22 and a first pipe portion 27. The first pipe portion 27 extends from the side portion 21 toward the first cylinder 1, and is hermetically connected to the first cylinder 1. The first pipe portion 27 is partially located in the first cavity 10. A pipe cavity of the first pipe portion 27 communicates with the second cavity 20 and an outside of the gas-liquid separation device 100. The axial direction of the gas-liquid separation device 100 is defined as a height direction. A height value of an opening of the first pipe portion 27 on the side portion 21 is a, and a length value of the second cylinder 2 in the axial direction of the gas-liquid separation device 100 is b, where $0.5\ b \geq a \geq 0.125\ b$. In this embodiment, since the opening of the first pipe portion 27 on the side portion 21 has a certain height, the second pipe portion 28 may not be provided. Of course, according to design requirements, the second pipe portion 28 can also be provided. It can be understood that in this embodiment, the first pipe portion 27 may also be hermetically connected with the first flow guide portion 4, and the first pipe portion 27 is generally L-shaped.

The gas-liquid separation assembly 7 is configured to achieve the gas-liquid separation function of a first fluid, so that the liquid first fluid after gas-liquid separation is stored in the second cavity 20. The gaseous first fluid enters the inner cavity of the gas-liquid separation assembly 7. The gaseous first fluid flowing out of the gas-liquid separation assembly 7 flows from the third cavity 30 into the first cavity 10. Then the gaseous first fluid performs heat exchange with the heat exchange assembly 6. The gas-liquid separation effect of the first fluid can be improved by designing the structure of the gas-liquid separation assembly 7. The liquid first fluid stored in the second cylinder 2 can be led out of the gas-liquid separation device 100 from the second cavity 20 through the first pipe portion 27 and the second pipe portion 28.

The heat exchange assembly 6 is configured to circulate a second fluid. One end of the heat exchange assembly 6 is connected to the first flow guide portion 4, and the other end of the heat exchange assembly 6 is connected to the second flow guide portion. When the gaseous first fluid flows through the first cavity 10, heat exchange occurs between the first fluid and the second fluid. The heat exchange effect between the first fluid and the second fluid can be improved by designing the structure of the heat exchange assembly 6.

The first flow guide portion 4 includes a first channel 41 communicating with the first cavity 10, a second channel 42 communicating with the inner cavity of the heat exchange assembly 6, and a communication channel 43 communicating with the pipe cavity of the first pipe portion 27. The first channel 41, the second channel 42 and the communication channel 43 are isolated in the first flow guide portion 4 so as not to be in communication with one another. The first end cover 3 of the second flow guide portion has a third channel 31 communicating with the second cavity 20 and a fourth channel 32 communicating with the inner cavity of the heat exchange assembly 6. The third channel 31 and the fourth channel 32 are isolated in the first end cover 3 so as not to be in communication with each other. The first channel 41, the second channel 42, the third channel 31, the fourth channel 32 and the communication channel 43 are respectively in communication with the outside of the gas-liquid separation device 100. The first fluid enters the second cavity 20 from the third channel 31, and due to the action of the gas-liquid separation assembly 7, the liquid first fluid is stored in the second cavity 20, and the gaseous first fluid enters the first cavity 10 via the third cavity 30. In the first cavity 10, the gaseous first fluid exchanges heat with the second fluid in the heat exchange assembly 6, and finally flows out of the gas-liquid separation device 100 from the first channel 41. According to the requirements of the thermal management system, the liquid first fluid stored in the second cavity 20 passes through the pipe cavity of the first pipe portion 27, the pipe cavity of the second pipe portion 28 and the communication channel 43, and flows out of the gas-liquid separation device 100 from the second cavity 20. According to the working mode of the thermal management system applied to the gas-liquid separation device 100, one of the second channel 42 and the fourth channel 32 serves as an inlet of the second fluid, and the other serves as an outlet of the second fluid.

The second end cover 5 includes a base portion 51 installed and fixed to the second cylinder 2, and a connecting pipe 52 extending from the base portion 51 in the axial direction of the gas-liquid separation device 100. One end of the connecting pipe 52 is hermetically connected to the base portion 51, and the other end of the connecting pipe 52 is hermetically connected to the first end cover 3. A pipe cavity of the connecting pipe 52 communicates with the third channel 31 and the second cavity 20, and part of the connecting pipe 52 is located in the third cavity 30.

In some embodiments, the second end cover 5 is provided with an outer extending portion 55 extending downwardly along an outer edge of the base portion 51. An outer wall surface of the outer extending portion 55 is in contact with an inner wall surface of the side portion 21. The outer extending portion 55 is interference-fitted with the side portion 21 of the second cylinder 2. The outer extending portion 55 is hermetically connected to the second cylinder 2.

In some embodiments, the side portion 21 includes an ear portion 26 extending in the axial direction of the gas-liquid separation device 100. The second end cover 5 includes an extension portion 54 extending from the base portion 51 toward a circumferential side. The extension portion 54 defines a cavity partially located in the ear portion 26. On a plane along the axial direction of the gas-liquid separation device 100, a projection of the extension portion 54 is overlapped with a projection of the ear portion 26. Through the installation and cooperation of the ear portion 26 and the extension portion 54, the second end cover 5 and the second cylinder 2 are installed.

The gas-liquid separation assembly 7 includes a cover body portion 71, a flow guide pipe 72, a sleeve 76 and a first filter assembly 73. The gas-liquid separation assembly 7 is installed and matched with the second end cover 5. Specifically, the base portion 51 has a first mounting tunnel 53 extending through the base portion 51 along the axial direction of the gas-liquid separation device 100. The cover body portion 71 includes a plate portion 711 and a limiting portion 712. The limiting portion 712 extends outward from the plate portion 711. After the installation is completed, part of the limiting portion 712 is located in the first mounting tunnel 53 and another part is located in the third cavity 30. The limiting portion 712 is installed and fixed to a hole wall of the first mounting tunnel 53.

The sleeve 76 is sleeved on an outside of the flow guide pipe 72. A fourth cavity 40 is provided between an outer wall surface of the flow guide pipe 72 and an inner wall surface of the sleeve 76. An inner cavity of the flow guide pipe 72 and the second cavity 20 are communicated with each other through the fourth cavity 40. The plate portion 711 is located above the sleeve 76 and the flow guide pipe 72. The cover body portion 71 defines a second mounting tunnel 713 extending through the cover body portion 71 along the axial direction of the gas-liquid separation device 100. Part of the flow guide pipe 72 is located in the second mounting tunnel 713. The flow guide pipe 72 has an interference fit with a hole wall of the second mounting tunnel 713. The first cavity 10 and the inner cavity of the flow guide pipe 72 are in communication through the third cavity 30.

On a plane perpendicular to the axial direction of the gas-liquid separation device 100, a projection of the limiting portion 712 is overlapped with a projection of the base portion 51, and the projection of the limiting portion 712 is overlapped with a projection of the flow guide pipe 72. By providing the limiting portion 712, the cover portion 71, the flow guide pipe 72 and the second end cover 5 can be installed, and the possibility of falling off among the three can be reduced.

A gap between an upper surface of the plate portion 711 and a lower surface of the second end cover 5 is provided, so that the first fluid can flow into the second cavity 20 from the connecting pipe 52. A gap between an outer wall surface of the plate portion 711 and an inner wall surface of the second cylinder 2 is provided, so that the first fluid continues to flow downwardly after entering the second cavity 20 from the connecting pipe 52. A gap between a lower surface of the plate portion 711 and an upper end surface of the sleeve 76 is provided, and a gap between an inner wall surface of the plate portion 711 and an outer wall surface of the sleeve 76 is provided. An end of the sleeve 76 close to the plate portion 711 is open, so that the second cavity 20 and the fourth cavity 40 are in communication. An end of the sleeve 76 away from the plate portion 711 is sealed, so that an inner cavity of the sleeve 76 is relatively isolated from the second cavity 20 at an end away from the plate portion 711. A gap between a lower end surface of the flow guide pipe 72 and a lower end surface of the sleeve 76 is provided, so that the fourth cavity 40 is in communication with an inner cavity of the flow guide pipe 72.

In this embodiment, the sleeve 76, the flow guide pipe 72 and the connecting pipe 52 are all hollow cylinders and the cross-sections of the hollow parts of the hollow cylinders are substantially circular. One end of the flow guide pipe 72 is connected to the cover body portion 71, and the pipe cavity of the flow guide pipe 72 is in communication with the third cavity 30. The other end of the flow guide pipe 72 is connected to the sleeve 76, and the pipe cavity of the flow guide pipe 72 is in communication with the fourth cavity 40. One end of the sleeve 76 close to the bottom portion 22 is self-sealing, and the other end is open and the pipe cavity of the sleeve 76 is in communication with the second cavity 20. An inner wall of one end of the sleeve 76 close to the bottom portion 22 is provided with a limiting structure (not shown in the drawings). An end of the flow guide pipe 72 extends into the limiting structure, thereby fixing the sleeve 76 and the flow guide pipe 72, which can be used to limit the displacement of the flow guide pipe 72. However, the design of the limiting structure does not affect the flow of the first fluid.

As shown in FIG. 7, a snap portion 24 is provided on a side of the bottom portion 22 facing the first flow guide portion 4. Correspondingly, the first flow guide portion 4 defines a limiting recess portion 44. At least part of the snap portion 24 is limited to the limiting recess portion 44. Through the limiting connection between the snap portion 24 and the limiting recess portion 44, it is beneficial to achieve a fixed connection between the second cylinder 2 and the first flow guide portion 4, and facilitates the assembly of the gas-liquid separation device.

In some embodiments, a balance hole (not shown) in communication with the fourth cavity 40 and the inner cavity of the flow guide pipe 72 is formed on a side wall of one end of the flow guide pipe 72 close to the cover body portion 71. The balance hole is used to reduce a phenomenon that the liquid first fluid is sucked into the compressor 200 due to the pressure difference when the compressor 200 is stopped.

In some embodiments, the gas-liquid separation assembly 7 further includes a molecular sieve 74, a collar 75 for fixing the molecular sieve 74, and a supporting bracket 763 for supporting the molecular sieve 74. The molecular sieve 74 is wrapped around the outside of sleeve 76 for absorbing moisture in the first fluid. The supporting bracket 763 may be part of the sleeve 76. A portion of a pipe wall of the sleeve 76 extends outward to form the supporting bracket 763. The supporting bracket 763 can also be a separately formed component and then fixed together with the sleeve 76.

The first filter assembly 73 is fixed to an end of the sleeve 76 close to the bottom portion 22. The first filter assembly 73 includes a bracket 731 and a filter screen (not shown in the drawings). The bracket 731 includes a plurality of window portions 732 spaced apart from one another for installing and fixing the filter screen. The bracket 731 is in contact between the sleeve 76 and the bottom portion 22, and is used to limit the sleeve 76 so as to reduce the shaking of the gas-liquid separation assembly 7. A first hole 761 is provided on a side wall of the sleeve 76 close to the bottom portion 22. The first hole 761 is used to guide the oil into the fourth cavity 40, and then enters the compressor 200 along with the flow of the gaseous first fluid. A diameter of the first hole 761 is matched according to the capacity of the thermal management system, so that the ratio of the refrigeration oil and the first fluid that are returned to the compressor 200 can be optimized. The filter screen can prevent impurities from entering the compressor 200 through the first hole 761.

In this embodiment, the first filter assembly 73 includes a first positioning portion 733. The sleeve 76 includes a second positioning portion 762. One of the first positioning portion 733 and the second positioning portion 762 is a protrusion, and a remaining one of the first positioning portion 733 and the second positioning portion 762 is a groove. The protrusion is located at least partially in the groove. The first hole 761 and the second positioning portion 762 are provided corresponding to a same window of the plurality of window portions 732. This arrangement prevents the bracket 731 from blocking the first hole 761, thereby affecting the oil return effect.

In some embodiments, the gas-liquid separation device includes a second filter assembly 8. The second filter assembly 8 is provided between the side portion 21 and the first flow guide portion 4. The second filter assembly 8 is arranged around the bottom portion 22. Specifically, a bottom end of the side portion 21 extends in a direction close to the first flow guide portion 4. A first matching groove 25 is formed between the extending portion and the bottom portion 22. The first flow guide portion is provided with a second matching groove 45. One end portion of the second filter assembly 8 is located in the first matching groove 25, and the other end portion is located in the second matching groove 45, so that the second filter assembly 8 is installed and positioned. The second filter assembly 8 includes a frame 81 and a filter screen for filtering. The material of the filter screen can be the same as the material of the filter screen of the first filter assembly 73. The frame 81 has a plurality of opening portions 82 spaced apart from one another for installing and fixing the filter screen. The second filter assembly 8 is used to filter the gaseous first fluid and oil before flowing out of the gas-liquid separation device 100 to maintain purity of the gaseous first fluid and oil.

In this embodiment, the heat exchange assembly 6 includes a first collecting pipe 61, a second collecting pipe 62, a heat exchange tube 63 and a heat exchange member 64. One end of the heat exchange tube 63 is connected to the first collecting pipe 61, and the other end of the heat exchange tube 63 is connected to the second collecting pipe 62. An inner cavity of the heat exchange tube 63 communicates with an inner cavity of the first collecting pipe 61 and an inner cavity of the second collecting pipe 62. Optionally, the heat exchange tube 63 is a micro-channel flat tube. The heat exchange tube 63 has a flat cross section. The heat exchange tube 63 defines a plurality of circulation channels spaced apart from one another. Each flow channel communicates with the inner cavity of the first collecting pipe 61 and the inner cavity of the second collecting pipe 62. The heat exchange member 64 is located between the heat exchange tube 63 and the second cylinder 2, and/or the heat exchange member 64 is located between the heat exchange tube 63 and the first cylinder 1, for enhancing the heat exchange effect between the first fluid and the second fluid.

In this embodiment, the heat exchange assembly 6 further includes a plurality of flow baffles 65. The flow baffles 65 are located between the first collecting pipe 61 and the second cylinder 2, and between the second collecting pipe 62 and the second cylinder 2. At least one flow baffle 65 is disposed on a side close to the first flow guide portion 4, and its lower end is flush with a lower end of the lowermost heat exchange tube 63. At least one flow baffle 65 is disposed on a side close to the second flow guide portion, and its upper end is flush with an upper end of the uppermost heat exchange tube 63. By providing the flow baffles 65, it reduces the possibility that the first fluid flowing out from the second cavity 20 directly enters a gap between the first collecting pipe 61 and the second cylinder 2, directly enters a gap between the second collecting pipe 62 and the second cylinder 2, and flows out of the first cavity 10 without exchanging heat with the second fluid in the heat exchange tube 63.

In this embodiment, the heat exchange assembly 6 further includes a first pipe joint assembly 66 and a second pipe joint assembly 67. One end of the first collecting pipe 61 is closed, and the other end is hermetically connected to the first pipe joint assembly 66. One end of the second collecting pipe 62 is sealed, and the other end is hermetically connected to the second pipe joint assembly 67. The first pipe joint assembly 66 is hermetically connected to the first flow guide portion 4. An inner cavity of the first pipe joint assembly 66 communicates with the inner cavity of the first collecting pipe 61 and the second channel 42. The second pipe joint assembly 67 is hermetically connected to the first end cover 3. An inner cavity of the second pipe joint assembly 67 communicates with the inner cavity of the second collecting pipe 62 and the fourth channel 32. Optionally, the structures of the first pipe joint assembly 66 and the second pipe joint assembly 67 are basically the same. As described above, the present disclosure provides an embodiment of the heat exchange assembly 6. Of course, as long as the heat exchange function can be achieved, the heat exchange assembly 6 can also be of other structures.

Figure 3:
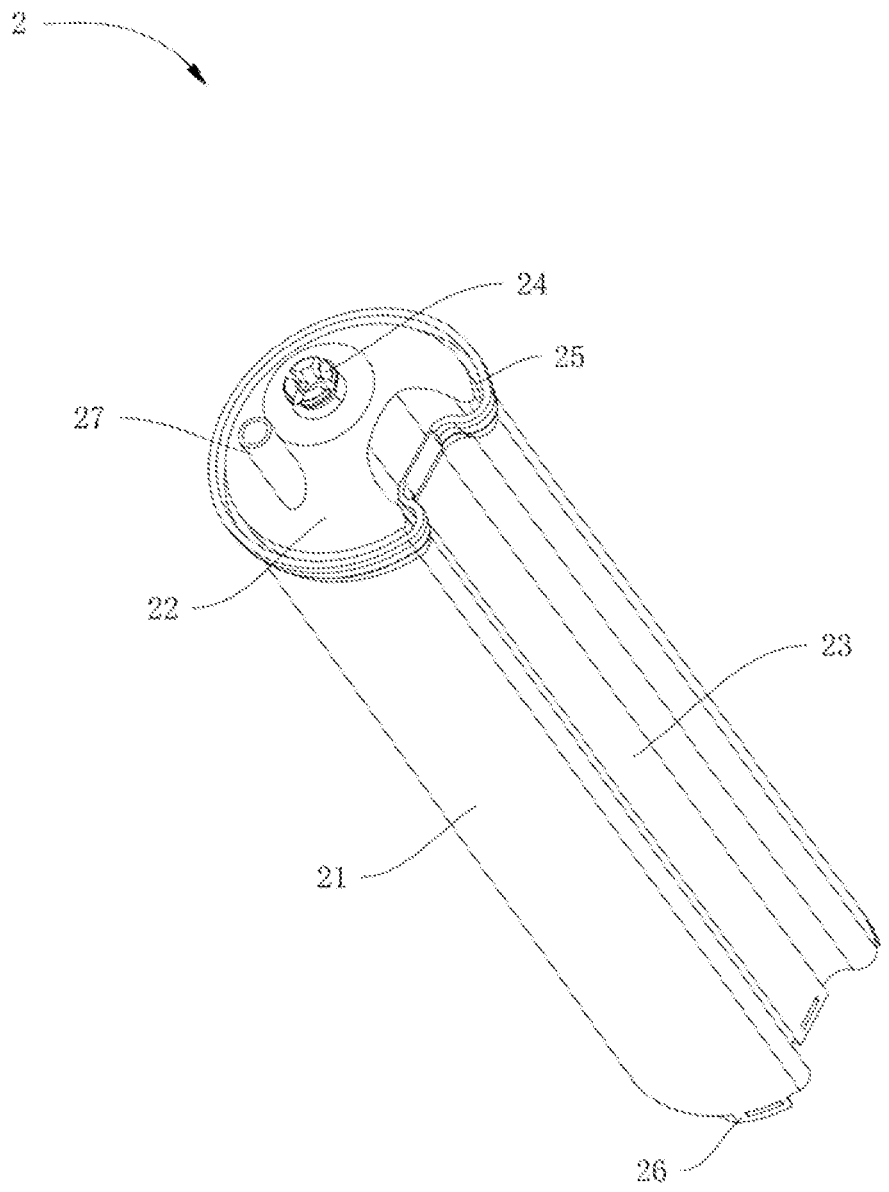
FIG. 3 is a schematic structural view of the second cylinder shown in FIG. 2.
Figure 4:
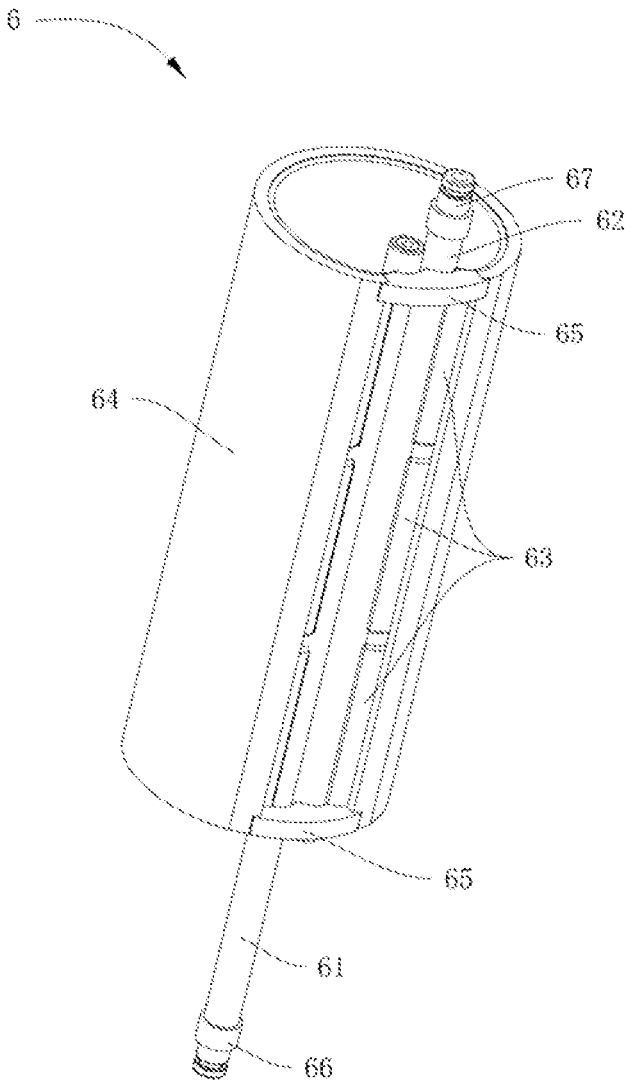
FIG. 4 is a schematic structural view of the heat exchange assembly shown in FIG. 2.
Figure 5:
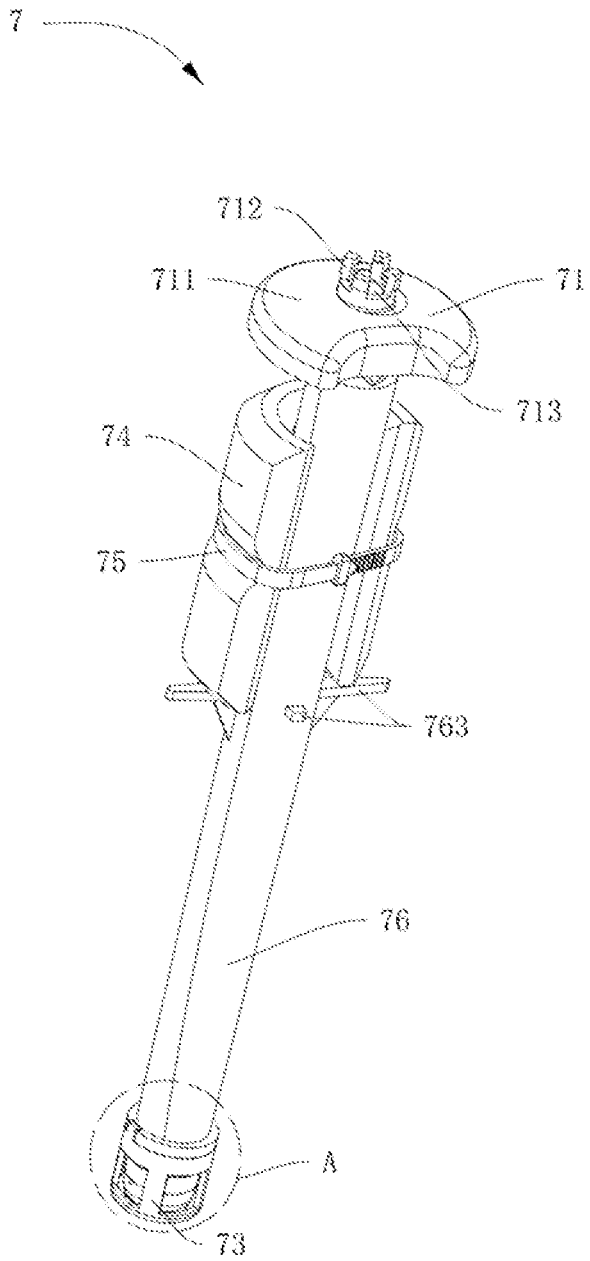
FIG. 5 is a schematic structural view of the gas-liquid separation assembly shown in FIG. 2.
Figure 6:
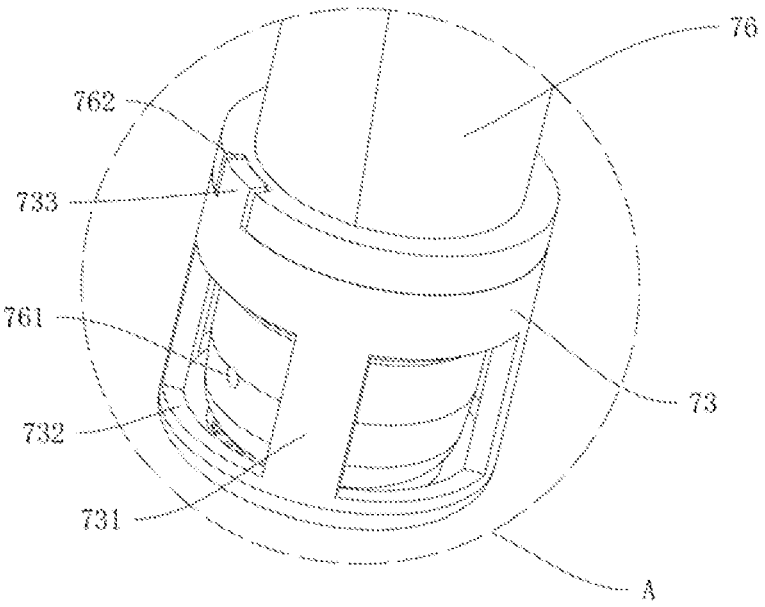
FIG. 6 is an enlarged schematic view of a circled portion A shown in FIG. 5.

In some embodiments, referring to FIG. 3, the heat exchange assembly 6 has a better heat exchange effect when the first collecting pipe 61 and the second collecting pipe 62 are larger in size. However, due to the limitation of the installation space, the size of the first cylinder 1 is relatively fixed. If a space in the first cylinder 1 is occupied to place the first collecting pipe 61 and the second collecting pipe 62, the second cavity 20 will be smaller. In order to balance the heat exchange effect and the size of the second cavity 20 in the second cylinder 2, the second cylinder 2 is provided with an avoidance groove 23 to accommodate the first collecting pipe 61 and the second collecting pipe 62, so that the second cavity 20 is made as large as possible.

Referring to FIG. 2, the avoidance groove 23 extends along the axial direction of the gas-liquid separation device. The gas-liquid separation device is provided with avoidance portions corresponding to an interior and end of the second cylinder 2. It can be understood that the second end cover 5 located above the second cylinder 2, the gas-liquid separation assembly 7 located inside the second cylinder 2, the second filter assembly 8, the first matching groove 25 and the second matching groove 45 that are located below the second cylinder 2 and so on, are all provided with corresponding avoidance portions on a side where the avoidance groove 23 is located, forming an avoidance space extending along the axial direction of the avoidance groove 23.

The gas-liquid separation assembly 7 includes a molecular sieve 74, a supporting bracket 763, a sleeve 76, and a cover body portion 71, all of which can be appropriately provided with avoidance portions in the axial direction so as to form necessary avoidance spaces formed on a side of a cylinder body close to the avoidance groove 23 for accommodating the heat exchange assembly 6.

In one embodiment, the second end cover 5 includes a first avoidance portion. The cover body portion 71 includes a second avoidance portion. The supporting bracket 763 includes a third avoidance portion. The sleeve 76 includes a fourth avoidance portion. Openings of the first avoidance portion, the second avoidance portion, the third avoidance portion and the fourth avoidance portion all face the avoidance groove 23, forming an avoidance space extending in a vertical direction along the axial direction of the gas-liquid separation device.

In addition, the sleeve 76 has a bell-shaped flow guide portion at one end away from the bottom portion 22, which can guide the liquid to flow back into the sleeve 76. It can be understood that the fourth avoidance portion is provided on a side of the bell mouth close to the avoidance groove 23 and is also provided with an avoidance structure.

In some other embodiments, the gas-liquid separation device 100 is not provided with the heat exchange assembly 6. The heat exchange assembly 6 is located outside the gas-liquid separation device 100. The first fluid flowing out of the first cavity 10 exchanges heat with the second fluid in the heat exchange assembly 6, or the first fluid in the first cavity 10 exchanges heat with the second fluid in the heat exchange assembly 6.

What needs to be understood in the present disclosure is that both the first fluid and the second fluid mentioned above are refrigerants. The first fluid and the second fluid are refrigerants flowing in different sections in the system.

The terms "roughly" and "approximately" mentioned in the present disclosure refer to a similarity of more than 50%. For example, the first cylinder 1 is approximately cylindrical, which means that the first cylinder 1 is hollow, a side wall of the first cylinder 1 may be provided with a recessed portion or a convex structure, a cross-sectional profile of the first cylinder 1 is not circular, but 50% of the profile is composed of arcs.

The gas-liquid separation device 100 of the present disclosure can be applied to a thermal management system, especially to a thermal management system using carbon dioxide refrigerant and having an ejector 300. The working pressure of the gas-liquid separation device 100 is used to transport the liquid first fluid out of the gas-liquid separation device 100 through the first pipe portion 27, and then into an evaporator 500 to complete a normal operation of a thermal management system.

Figure 9:
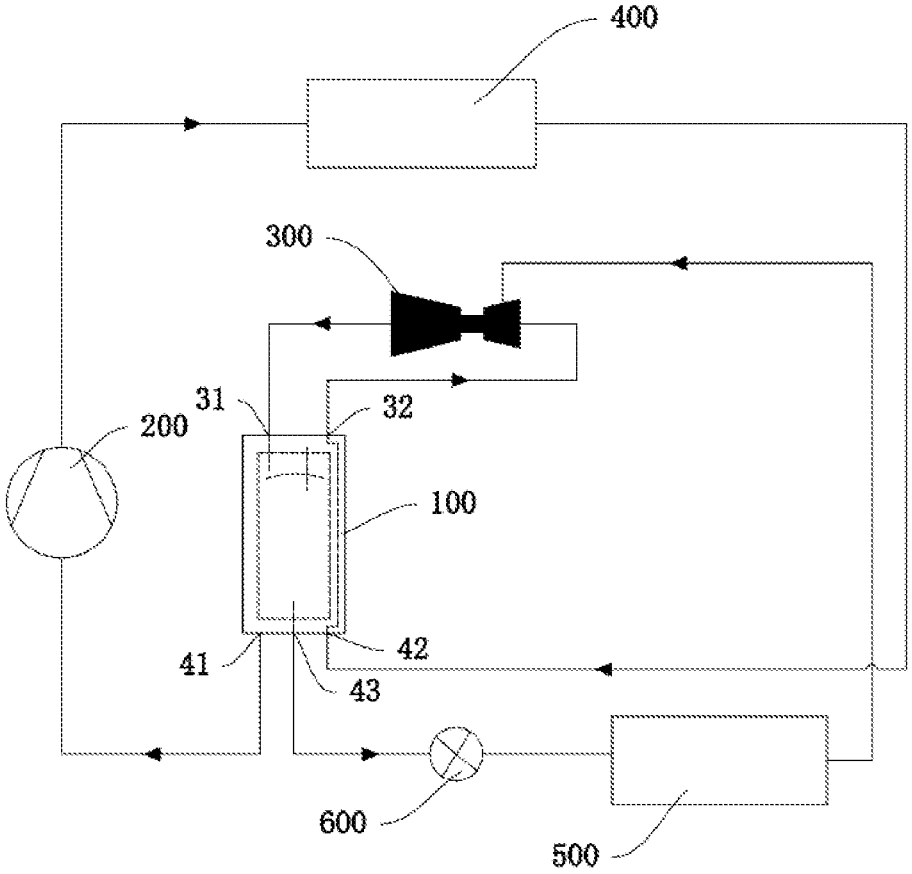
FIG. 9 is a schematic connection view of a thermal management system in accordance with an embodiment of the present disclosure.

According to a specific embodiment of the thermal management system of the present disclosure, as shown in FIG. 9, the thermal management system includes a gas-liquid separation device 100, a compressor 200, an ejector 300, a condenser 400, an evaporator 500 and an expansion valve 600. The ejector 300 has a first inlet, a second inlet and a first outlet. The working principle of the ejector 300 is well known to those skilled in the art and will not be described in detail in the present disclosure.

An outlet of the compressor 200 is in communication with an inlet of the condenser 400; an outlet of the condenser 400 is in communication with the second channel 42 of the gas-liquid separation device 100; the fourth channel 32 of the gas-liquid separation device 100 is in communication with the first inlet of the ejector 300; the second inlet of the ejector 300 is in communication with an outlet of the evaporator 500; an inlet of the evaporator 500 is in communication with an outlet of the expansion valve 600; an inlet of the expansion valve 600 is in communication with the communication channel 43 of the gas-liquid separation device 100; the first outlet of the ejector 300 is in communication with the third channel 31 of the gas-liquid separation device 100; the first channel 41 of the gas-liquid separation device 100 is in communication with an inlet of the compressor 200.

When the thermal management system is in operation, the refrigerant flowing out of the compressor 200 flows into the condenser 400. The refrigerant flowing out from the condenser 400 enters the gas-liquid separation device 100 through the second channel 42. In the gas-liquid separation device 100, the refrigerant flows through the inner cavity of the heat exchange assembly 6, and then flows out of the gas-liquid separation device 100 from the fourth channel 32. Then the refrigerant enters the ejector 300 from the first inlet. After the refrigerant is mixed with the refrigerant entering the ejector 300 from the second inlet, it flows out of the ejector 300 from the first outlet. Then the refrigerant enters the gas-liquid separation device 100 from the third channel 31. In the gas-liquid separation device 100, after the refrigerant in the first cavity 10 exchanges heat with the refrigerant in the heat exchange assembly 6, it flows out of the gas-liquid separation device 100 from the first channel 41 and then flows into the inlet of the compressor 200. Due to the working pressure in the gas-liquid separation device 100, the liquid refrigerant can be led out of the gas-liquid separation device 100 from the communication channel 43. After the refrigerant flows through the expansion valve 600 in a throttling state, it flows into the evaporator 500, and then flows into the ejector 300 through the second inlet, thus completing a cycle. According to the design of the thermal management system, heating or cooling or other functions can be achieved.

In the present disclosure, the first pipe portion 27 is provided in the second cylinder 2 so that when it is used in a thermal management system, the liquid refrigerant in the second cavity 20 can be led out of the gas-liquid separation device 100. By utilizing a relatively simple and reliable structure, a gas-liquid separation device 100 with heat exchange, gas-liquid separation and liquid return functions is provided.

The above descriptions are only preferred embodiments of the present disclosure, and do not limit the present disclosure in any form. Although the present disclosure has been disclosed above in terms of preferred embodiments, this is not intended to limit the present disclosure. Those of ordinary skill the art can make slight changes or modifications to equivalent embodiments with equivalent changes using the technical content disclosed above without departing from the scope of the technical solution disclosed above. However, any simple modifications, equivalent changes and modifications made to the above embodiments based on the technical essence of the present disclosure that do not deviate from the content of the technical solution of the present disclosure still fall within the scope of the technical solution of the present disclosure.

What is claimed is:

1. A gas-liquid separation device, comprising: a first cylinder, a second cylinder, a heat exchange assembly and a gas-liquid separation assembly; the second cylinder being located inside the first cylinder; the gas-liquid separation device defining a first cavity and a second cavity; the first cavity at least comprising a space between the first cylinder and the second cylinder; the second cavity at least comprising an inner cavity of the second cylinder; the gas-liquid separation assembly being at least partially located in the second cavity; an inner cavity of the gas-liquid separation assembly being in communication with the first cavity and the second cavity; at least part of the heat exchange assembly being located in the first cavity;

wherein the gas-liquid separation device comprises a first pipe portion; a pipe cavity of the first pipe portion communicates with the second cavity and an outer space of the first cylinder;

the gas-liquid separation device further comprises a first flow guide portion and a second flow guide portion; the first flow guide portion and the second flow guide portion are hermetically connected to opposite ends of the first cylinder, respectively, in an axial direction of the first cylinder; wherein the second cylinder is integrally of one piece; the second cylinder comprises a main body portion in which the second cavity is located; the main body portion comprises a side portion and a bottom portion; the side portion extends along an axial direction of the gas-liquid separation device; the bottom portion is hermetically connected to an end portion of the side portion away from the second flow guide portion; one end of the side portion away from the bottom portion is fixed to the second flow guide portion; the bottom portion and the first flow guide portion are fixedly arranged.

2. The gas-liquid separation device according to claim 1, wherein the first pipe portion is connected to a bottom wall of the second cylinder, or the first pipe portion is connected to a lower end portion of a side wall of the second cylinder; the first pipe portion and the second cylinder are hermetically connected.

3. The gas-liquid separation device according to claim 1, wherein the first pipe portion extends from the bottom portion along the axial direction of the gas-liquid separation device; the first pipe portion is hermetically connected to the first flow guide portion; the first flow guide portion defines a communication channel; the pipe cavity of the first pipe portion is in communication with the communication channel; the communication channel is in communication with the outer space of the first cylinder.

4. The gas-liquid separation device according to claim 1, wherein the first pipe portion extends from the side portion in a direction toward the first cavity; the first pipe portion is hermetically connected to the first cylinder or the first flow guide portion.

5. The gas-liquid separation device according to claim 3, wherein the second cylinder comprises a second pipe portion which extends from the main body portion toward the second cavity; the pipe cavity of the first pipe portion is in communication with a pipe cavity of the second pipe portion; the pipe cavity of the second pipe portion is in communication with the second cavity.

6. The gas-liquid separation device according to claim 5, wherein the axial direction of the gas-liquid separation device is defined as a height direction; a height of an extending end of the second pipe portion is greater than or equal to ⅛ of a height of the second cylinder, but is less than or equal to ½ of the height of the second cylinder.

7. The gas-liquid separation device according to claim 1, wherein the second flow guide portion comprises a first end cover and a second end cover; the first end cover and the second end cover are fixedly arranged; the first end cover is hermetically connected to the first cylinder; the second end cover is hermetically connected to the second cylinder; the first flow guide portion defines a third cavity; the third cavity comprises at least a space between the first end cover and the second end cover;

the second end cover comprises a base portion and a connecting pipe; one end of the connecting pipe is hermetically connected to the base portion; another end of the connecting pipe is hermetically connected to the first end cover; a pipe cavity of the connecting pipe is in communication with a space outside the gas-liquid separation device and the second cavity; part of the connecting pipe is located in the third cavity; the base portion has a first mounting tunnel extending through the base portion along the axial direction of the gas-liquid separation device; part of the gas-liquid separation assembly is located in the first mounting tunnel; the gas-liquid separation assembly is installed and fixed to a hole wall of the first mounting tunnel; the first cavity and the inner cavity of the gas-liquid separation assembly are in communication through the third cavity.

8. The gas-liquid separation device according to claim 7, wherein the gas-liquid separation assembly comprises a cover body portion and a flow guide pipe; the cover body portion comprises a limiting portion; the cover body portion defines a second mounting tunnel extending through the cover body portion along the axial direction of the gas-liquid separation device; part of the flow guide pipe is located in the second mounting tunnel; the flow guide pipe has an interference fit with a hole wall of the second mounting tunnel; an inner cavity of the flow guide pipe is in communication with the third cavity; part of the limiting portion is located in the first mounting tunnel and another part of the limiting portion is located in the third cavity; on a plane perpendicular to the axial direction of the gas-liquid separation device, a projection of the limiting portion is overlapped with a projection of the base portion, and a projection of the limiting portion is overlapped with a projection of the flow guide pipe.

9. The gas-liquid separation device according to claim 8, wherein the gas-liquid separation assembly comprises a sleeve and a first filter assembly; part of the flow guide pipe is located inside the sleeve; a fourth cavity is provided between an outer wall surface of the flow guide pipe and an inner wall surface of the sleeve; the inner cavity of the flow guide pipe and the second cavity are in communication through the fourth cavity;

the first filter assembly comprises a plurality of window portions for installing filter screens; the sleeve defines a first hole extending through a wall of the sleeve; the first hole is provided at an end portion of the sleeve away from the cover body portion; the first filter assembly comprises a first positioning portion; the sleeve comprises a second positioning portion; one of the first positioning portion and the second positioning portion is a protrusion, and a remaining one of the first positioning portion and the second positioning portion is a groove; the protrusion is at least partially located in the groove; the first hole and the second positioning portion are provided corresponding to a same window of the plurality of window portions.

10. The gas-liquid separation device according to claim 1, wherein the first flow guide portion defines a first channel and a second channel; the second flow guide portion defines a third channel and a fourth channel; the first channel is in communication with the first cavity; the third channel is in communication with the second cavity; the second channel and the fourth channel are in communication through an inner cavity of the heat exchange assembly.

11. The gas-liquid separation device according to claim 1, wherein the second cylinder defines an avoidance groove; the side portion and the bottom portion are of one piece; the heat exchange assembly is disposed between the first cylinder and the second cylinder; the heat exchange assembly comprises a first collecting pipe and a second collecting pipe; the avoidance groove extends from the side portion to the bottom portion along the axial direction of the gas-liquid separation device; the first collecting pipe and the second collecting pipe are at least partially accommodated in the avoidance groove.

12. The gas-liquid separation device according to claim 1, wherein the second flow guide portion includes a second end cover which is closed on a side of the second cylinder away from the bottom portion; the gas-liquid separation assembly is installed and matched with the second end cover; the gas-liquid separation assembly includes a cover body portion which is received in an inner cavity of the second cylinder; the second end cover includes a first avoidance portion; the cover body portion includes a second avoidance portion; an opening of the first avoidance portion and an opening of the second avoidance portion both face the avoidance groove.

13. The gas-liquid separation device according to claim 1, wherein an end of the side portion away from the bottom portion is fixed to the second flow guide portion; the bottom portion and the first flow guide portion are fixedly arranged; a second filter assembly is disposed between the side portion and the first flow guide portion; the second filter assembly is disposed around the bottom portion.

14. A gas-liquid separation device, comprising: a first cylinder, a first end cover, a second cylinder, a second end cover and a gas-liquid separation assembly; the second end cover and the second cylinder being fixedly arranged;

wherein the gas-liquid separation device defines a first cavity and a second cavity; the gas-liquid separation assembly is at least partially located in the second cavity;

the second end cover comprises a base portion; the base portion defines a first mounting tunnel extending through the base portion along an axial direction of the gas-liquid separation device; the gas-liquid separation assembly comprises a cover body portion which comprises a plate portion and a limiting portion; the limiting portion extends outward from the plate portion; the limiting portion is at least partially located and snap-fastened in the first mounting tunnel;

the gas-liquid separation device further comprises a first flow guide portion and a second flow guide portion; the first flow guide portion and the second flow guide portion are hermetically connected to opposite ends of the first cylinder, respectively, in an axial direction of the first cylinder; wherein the second cylinder is integrally of one piece; the second cylinder comprises a main body portion in which the second cavity is located; the main body portion comprises a side portion and a bottom portion; the side portion extends along the axial direction of the gas-liquid separation device; the bottom portion is hermetically connected to an end portion of the side portion away from the second flow guide portion; one end of the side portion away from the bottom portion is fixed to the second flow guide portion; the bottom portion and the first flow guide portion are fixedly arranged.

15. The gas-liquid separation device according to claim 14, wherein the gas-liquid separation assembly comprises a flow guide pipe which is mounted to the second end cover by cooperating with the limiting portion; on a plane perpendicular to the axial direction of the gas-liquid separation device, a projection of the limiting portion is at least partially overlapped with a projection of the base portion, and the projection of the limiting portion is at least partially overlapped with a projection of the flow guide pipe.

16. The gas-liquid separation device according to claim 14, wherein the second end cover comprises an extension portion extending from the base portion toward a circumferential side; an end of the second cylinder comprises an ear portion extending along the axial direction of the gas-liquid separation device; the extension portion at least partially extends into the ear portion for installation.

17. The gas-liquid separation device according to claim 14, wherein the gas-liquid separation assembly comprises a sleeve and a flow guide pipe; the sleeve is sleeved on an outside of the flow guide pipe; the cover body portion comprises a second mounting tunnel extending through the cover body portion along the axial direction of the gas-liquid separation device; the flow guide pipe is at least partially interference-fitted with a hole wall of the second mounting tunnel; a gap is formed between a lower surface of the plate portion and an upper end surface of the sleeve.

18. The gas-liquid separation device according to claim 14, further comprising a heat exchange assembly; wherein the second cylinder is located inside the first cylinder; the first cavity comprises at least a space between the first cylinder and the second cylinder; at least part of the heat exchange assembly is located in the first cavity; an outlet of the gas-liquid separation assembly communicates with the first cavity.

19. A thermal management system, comprising: a compressor, an evaporator, a condenser, an expansion valve, an ejector and a gas-liquid separation device;

wherein the gas-liquid separation device comprises a first cylinder, a second cylinder, a heat exchange assembly and a gas-liquid separation assembly; the second cylinder is at least partially located inside the first cylinder; the gas-liquid separation device defines a first cavity and a second cavity; the first cavity at least comprises a space between the first cylinder and the second cylinder; the second cavity at least comprises an inner cavity of the second cylinder; the gas-liquid separation assembly is at least partially located in the second cavity; an inner cavity of the gas-liquid separation assembly is in communication with the first cavity and the second cavity; at least part of the heat exchange assembly is located in the first cavity;

the gas-liquid separation device comprises a first pipe portion; a pipe cavity of the first pipe portion communicates with the second cavity and an outer space of the first cylinder;

an outlet of the compressor communicates with an inlet of the condenser; an outlet of the condenser communicates with a first inlet of the ejector; an outlet of the evaporator communicates with a second inlet of the ejector; a first outlet of the ejector communicates with the second cavity; the first cavity communicates with an inlet of the compressor; an inlet of the evaporator communicates with an outlet of the expansion valve; and an inlet of the expansion valve communicates with the pipe cavity of the first pipe portion;

the gas-liquid separation device further comprises a first flow guide portion and a second flow guide portion; the first flow guide portion and the second flow guide portion are hermetically connected to opposite ends of the first cylinder, respectively, in an axial direction of the first cylinder; wherein the second cylinder is integrally of one piece; the second cylinder comprises a main body portion in which the second cavity is located; the main body portion comprises a side portion and a bottom portion; the side portion extends along an axial direction of the gas-liquid separation device; the bottom portion is hermetically connected to an end portion of the side portion away from the second flow guide portion; one end of the side portion away from the bottom portion is fixed to the second flow guide portion; the bottom portion and the first flow guide portion are fixedly arranged.

* * * * *